US005689080A

United States Patent [19]

Gulick

[11] Patent Number: 5,689,080

[45] Date of Patent: Nov. 18, 1997

[54] COMPUTER SYSTEM AND METHOD FOR PERFORMING WAVETABLE MUSIC SYNTHESIS WHICH STORES WAVETABLE DATA IN SYSTEM MEMORY WHICH MINIMIZES AUDIO INFIDELITY DUE TO WAVETABLE DATA ACCESS LATENCY

[75] Inventor: Dale E. Gulick, Austin, Tex.

[73] Assignee: Advanced Micro Devices, Inc., Sunnyvale, Calif.

[21] Appl. No.: 622,761

[22] Filed: Mar. 25, 1996

[51] Int. Cl.[6] ..... G10H 7/02

[52] U.S. Cl. ..... 84/604; 84/621

[58] Field of Search ..... 84/604–607, 621–625

[56] References Cited

U.S. PATENT DOCUMENTS

| | | | |
|---|---|---|---|
| 5,486,644 | 1/1996 | Kudo et al. | 84/604 |
| 5,539,145 | 7/1996 | Kuribayashi et al. | 84/604 |
| 5,553,011 | 9/1996 | Fujita | 84/604 X |

OTHER PUBLICATIONS

Tom R. Halfhill, "The New PC," BYTE Magazine Cover Story, Oct. 1995, 6 pages.

The MIDI Manufacturers Association, Los Angeles, California, "Tutorial on MIDI and Music Synthesis," The Complete MIDI 1.0 Detailed Specification, Incorporating all Recommended Practices, document version 95.1, 1995, 24 pages.

*Primary Examiner*—Stanley J. Witkowski

*Attorney, Agent, or Firm*—Conley, Rose & Tayon; Jeffrey C. Hood; E. Alan Davis

[57] ABSTRACT

A computer system and method for performing wavetable music synthesis which uses system memory to store wavetable data and minimizes audio infidelity introduced by wavetable data access latency. The system comprises a system memory which stores wavetable data, an I/O bus coupled to the system memory, and a system audio device. The system audio device comprises an I/O bus interface coupled to the I/O bus, a synthesizer which generates sounds in response to the wavetable data, a plurality of buffers coupled to the I/O bus interface and to the synthesizer for buffering the wavetable data from the system memory, and a buffer manager coupled to the I/O bus interface, the synthesizer, and the plurality of buffers. The buffer manager manages transfers of the wavetable data from the system memory to the buffers and from the buffers to the synthesizer. The synthesizer generates a request to the buffer manager for wavetable data samples. If the samples do not reside in the buffers and the buffer manager is unable to retrieve the samples from the system memory within a desired frame time, the synthesizer outputs surrogate values until the samples become available. The synthesizer calculates the surrogate values so as to avoid producing audible artifacts in the sound generated by the synthesizer. The synthesizer calculates the surrogate values according to one of two methods. The first method is to simply output the last valid value calculated by the synthesizer. The second method is to ramp the value toward zero at a rate defined as the fastest rate which does not produce audible artifacts.

15 Claims, 10 Drawing Sheets

COMPUTER SYSTEM AND METHOD FOR PERFORMING WAVETABLE MUSIC SYNTHESIS WHICH STORES WAVETABLE DATA IN SYSTEM MEMORY WHICH MINIMIZES AUDIO INFIDELITY DUE TO WAVETABLE DATA ACCESS LATENCY

BACKGROUND OF THE INVENTION

1. Field of the Invention

This invention is related to the field of computer systems which perform music synthesis and, more particularly, to a computer system which includes wavetable synthesizer logic and which stores a plurality of wavetables of sampled data from a variety of voice sources in system memory which minimizes audio infidelity introduced by wavetable data access latency.

2. Description of the Relevant Art

Personal computer (PC) audio systems have traditionally employed a technique called Frequency Modulation (FM) synthesis to generate audio sounds. FM synthesis works by combining the outputs of multiple sine wave oscillators which are relatively close in frequency to produce complex sound waves with close-to-natural timbres, attacks and delays. An advantage of FM synthesis is that it is relatively inexpensive to implement. A disadvantage is FM synthesized sounds are generally recognizable as synthesized sounds. A new music synthesis method, wavetable music synthesis, has the advantage of producing more life-like sounds than FM synthesis.

Wavetable music synthesizers store digitally sampled audio data in digital memory. Typically, wavetable synthesizers do not store a sample of each note which the instrument is capable of playing. Rather, to minimize the memory requirement, wavetable synthesizers typically store samples of a few representative notes of the instrument. For example, a wavetable music synthesizer might store eight of the eighty-eight possible notes of a piano. Wavetable synthesizers then retrieve one of these stored data samples, shift the pitch of the sampled data to the desired new pitch, and then perform digital-to-analog conversion on the new data so that an analog device such as a speaker or headphone can reproduce the original sound. Often many audio sources, also known as voices, are sampled and stored in memory. Examples of such voices are musical instruments and human voices. A collection of samples of one or more voices is commonly referred to as wavetable data.

Historically, wavetable music synthesizers have employed their own dedicated memory to store wavetable data. For example, a prior art wavetable music synthesizer may generally include one megabyte or more of Read Only Memory (ROM) to store wavetable data. This dedicated memory often represents a significant fraction of the total cost of a personal computer audio system.

Turning now to FIG. 1, a prior art computer system 100 including a CPU 101, a system memory 102, a chipset 104, and an audio card 120 are shown. Chipset 104 and audio card 120 are coupled to an Industry Standard Architecture (ISA) bus 106 commonly found in personal computers. Chipset 104 couples CPU 101, system memory 102 and ISA bus 106 together. Audio card 120 contains a dedicated ROM 122 for storing wavetable data. Audio card 120 employs wavetable synthesis on the data contained in the dedicated wavetable data ROM 122 in response to commands from CPU 101 to generate sound through speakers 108. One example of such an audio card 120 is the Sound Canvas product manufactured by Roland Corporation.

The cost of having a dedicated memory to store wavetable data could be eliminated by using the personal computer's system memory to store wavetable data. Applicant is aware of various unified memory architectures which attempt to store video data in the main or system memory. This approach has not been practical, however, because of bandwidth and bus mastering issues associated with the system bus.

Personal Computer system I/O buses have not provided enough bandwidth for a unified memory architecture implementation. A typical Industry Standard Architecture (ISA) bus implementation, for example, is only capable of sustaining a bandwidth of a few megabytes per second. As will be shown, a wavetable synthesizer would consume most, if not all, of this bandwidth leaving little or none for other functions in the system. With the advent of the Peripheral Component Interconnect (PCI) bus, this problem has been eliminated in that PCI bus implementations are capable of sustaining on the order of 100 MB/second.

The PCI bus, however, introduces some additional problems. Specifically, PCI is tied very closely with the PC's CPU. As a result the PCI bus has been optimized around the burst nature of refilling the CPU's cache memory. Further, the latency involved in gaining control of the PCI bus once a request for bus mastership is generated is both significant and indeterminate. PCI bus master latency is typically 2–3 microseconds, often 20–30 microseconds, and delays as long as 100–200 microseconds are possible.

A typical wavetable synthesizer can have multiple voices active simultaneously. The number of simultaneous active voices is referred to as the polyphony of the synthesizer. A wavetable synthesizer operates as a Digital Signal Processor (DSP) system, and as such has an associated sample rate hereinafter called the frame rate, which we will assume is 44,100 frames per second. During each frame time, which is the reciprocal of the frame rate (22.7 microseconds at a frame rate of 44,100 frames per second), the synthesizer must calculate a new output value for each of the active voices (up to 32 in our example). Assuming the polyphony is 32, this implies that the DSP hardware must process up to 44,100×32=1,411,200 voice outputs per second. To process a voice output, the DSP must fetch a pair of wavetable data samples from memory. If the wavetable data samples are stored in system memory, the synthesizer must fetch 2×1,411,200=2,822,400 data samples from system memory per second. Hence, the DSP must be fed with data at a rate of two samples every 708 nanoseconds. Since the data samples are typically one byte or two bytes wide the necessary bandwidth would be in excess of 5 MB/sec. Since the PCI bus has a theoretical burst bandwidth of 132 MB/sec (in a 32 bit wide PCI implementation, or 264 MB/sec in a 64 bit wide PCI implementation), bus bandwidth is not a problem in fetching the data over the PCI bus. However, problems arise due to the nature in which synthesizers generate addresses for the sample data.

One of the main functions of a wavetable synthesizer is to shift the pitch (frequency) of the stored wavetable data. The sound of a given voice is stored at one or more pitches in wavetable memory. To be of any use, the synthesizer must be able to play back all the notes the instrument is capable of playing. To do this, the pitch of one of the stored notes must be shifted from the stored value to the desired new value. This is performed by a process called interpolation, which involves interpolating new values between the stored wavetable sample to produce a new wavetable audio sample having a different pitch. Three key points about interpolation are relevant: 1) for each calculation, the synthesizer requires two data samples to interpolate between; 2) the addresses at which these samples are stored in wavetable memory are calculated as part of the interpolation process—that is to say, they are only available up to one frame time in advance of when the data is needed; and 3) successive samples are stored sequentially, but because of the interpolation process, it takes an indeterminate amount of time (as measured in frames) to step through a given number of samples.

As a further complication, to reduce the amount of wavetable data that must be stored, wavetable synthesizers can repetitively "loop" through the data samples. For example if a sine wave is to be played, only one cycle of the sine wave is stored in memory. The synthesizer starts at the beginning, steps through the various samples comprising the sine wave, then loops back to the beginning. Wavetable synthesizers typically can loop from end to beginning (forward), beginning to end (backward), and reverse direction (i.e., start at the beginning, move to the end, and then work backward in the opposite direction back through the data to the beginning). Hence, typically data can be fetched sequentially, but not always. Additionally, data must be able to be fetched sequentially by both incrementing and decrementing addresses.

When performing digital-to-analog (D/A) conversion on sampled audio data, as is done in wavetable music synthesizers, the data samples are supplied to a D/A converter. Each data sample has an associated arithmetic value which is supplied to the D/A converter. A ramp rate, or slope, exists between the arithmetic values of any two consecutive samples. Audible artifacts, such as a "pop" from the speaker or other audio output device, are heard in the reproduced sound if two consecutive samples of audio data are supplied to the D/A converter which have a slope beyond a maximum value. These audible artifacts are commonly referred to as "zipper noise".

When D/A converters are not supplied with a sample value at their clock edge, i.e., not supplied at the required sample rate, in this case at or above the Nyquist frequency, the D/A converter can interpret the value as either the minimum or maximum arithmetic value receivable by the D/A converter. Hence, if samples are not supplied to an audio D/A converter on time there exists a high probability of creating unwanted pops and clicks.

SUMMARY OF THE INVENTION

The problems outlined above are in large part solved by a system and method for performing wavetable music synthesis which uses system memory to store wavetable data which minimizes audio infidelity introduced by wavetable data access latency in accordance with the present invention. The system and method described herein utilizes the benefits of a high bandwidth I/O bus while mitigating the disadvantages introduced by having to arbitrate for a shared system bus. By using system memory for storing wavetable data, a more cost effective PC audio system can be produced.

In the preferred embodiment a computer system is provided that includes a system memory, which has as one of its functions to store wavetable data samples, a PCI bus, and an integrated circuit which functions as a PCI-based audio synthesis device. The audio synthesis device includes a PCI bus interface, a synthesizer, and a plurality of buffers coupled to the PCI bus interface and the synthesizer. The buffers receive wavetable data samples from system memory. Each buffer has a characteristic sample depth and the number of buffers defines the polyphony of the synthesizer; i.e., the number of buffers defines the maximum number of voices which can simultaneously be active. Each active buffer corresponds to an active voice. The buffer sizes are preferably small to minimize the size of the integrated circuit die area, and thus the cost of the integrated circuit due to increased yield. Conversely, the buffer sizes are also preferably sufficiently large to minimize the rate of PCI bus mastership requests and to maximize the allowed latency of obtaining PCI bus mastership.

The audio synthesis device also includes a buffer manager which controls the operation of the buffers. The buffer manager, in conjunction with the buffer depth, maximizes allowed PCI bus latency by maintaining a highest sample pointer for each buffer and requests PCI bus mastership to generate a request to fill the active buffers when the pointer has reached a predetermined threshold, that is, when the buffers have become a predetermined amount empty. By filling all active buffers at the same time, the device minimizes the total number of PCI bus mastership requests to a manageable value. The buffer manager is also capable of individually flushing and refilling an individual buffer, typically in response to looping or activating of a new voice.

In the event that the desired wavetable data samples are unable to be retrieved from system memory within the frame time the synthesizer outputs one or more surrogate values calculated so as to avoid introducing zipper noise. Two methods are used to calculate the surrogate values. The first method is to simply output the last valid value calculated by the synthesizer. The second method is to ramp the value toward zero at a rate defined as the fastest rate which does not produce audible artifacts.

Broadly speaking the present invention contemplates a computer system and method for performing wavetable music synthesis which uses system memory to store wavetable data and minimizes audio infidelity introduced by wavetable data access latency. The system comprises a system memory which stores wavetable data, an I/O bus coupled to the system memory, and a system audio device. The system audio device comprises an I/O bus interface coupled to the I/O bus, a synthesizer which generates sounds in response to the wavetable data, a plurality of buffers coupled to the I/O bus interface and to the synthesizer for buffering the wavetable data from the system memory, and a buffer manager coupled to the I/O bus interface, the synthesizer, and the plurality of buffers. The buffer manager manages transfers of the wavetable data from the system memory to the buffers and from the buffers to the synthesizer.

The synthesizer generates a request to the buffer manager for wavetable data samples. If the samples do not reside in the buffers and the buffer manager is unable to retrieve the samples from the system memory within a desired frame time, the synthesizer outputs surrogate values until the samples become available. The synthesizer calculates the surrogate values so as to avoid producing audible artifacts in the sound generated by the synthesizer. The synthesizer calculates the surrogate values according to one of the two previously described methods.

BRIEF DESCRIPTION OF THE DRAWINGS

Other objects and advantages of the invention will become apparent upon reading the following detailed description and upon reference to the accompanying drawings in which.

Figure 1:
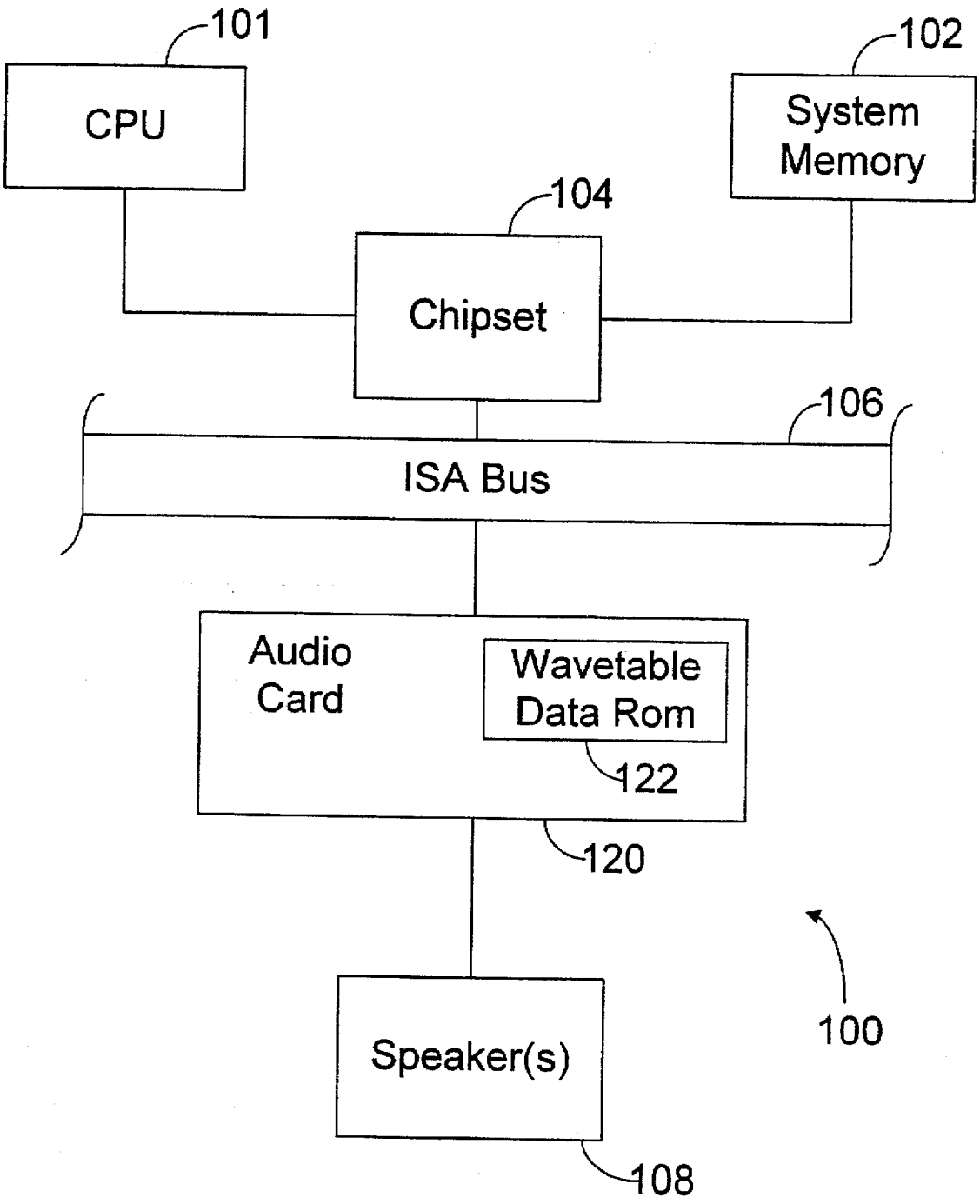
Fig. 1 (Prior Art)
FIG. 1 is a block diagram of a prior art computer system having an audio card which performs wavetable music synthesis.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENT

Figure 2:
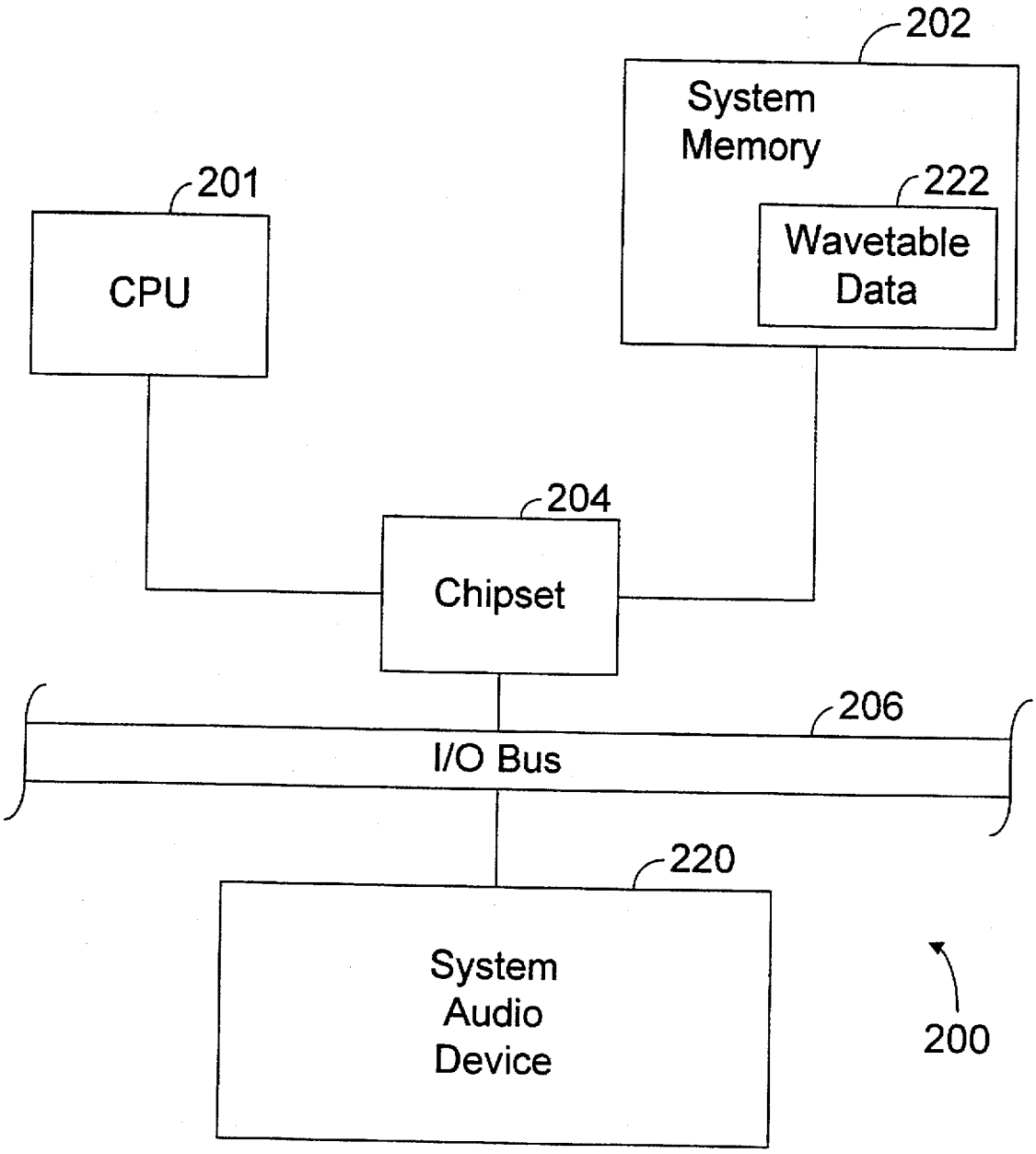
FIG. 2 is a block diagram of a computer system having a system audio device which performs wavetable music synthesis via wavetable data stored in the system memory.

Turning now to FIG. 2, a currently preferred embodiment of a computer system 200 according to the present invention is shown. The computer system 200 includes a CPU 201, a system memory 202, a chipset 204, and a system audio device 220. Chipset 204 and audio device 220 are coupled to an I/O bus 206. Audio device 220 generates sound through an analog device such as speakers or headphones. According to the present invention, the system memory 202 stores wavetable data used by the audio device 220. The audio device 220 employs wavetable synthesis on the wavetable data 222 contained in system memory 202. Thus, the cost of a dedicated memory for storing wavetable data, as in the prior art embodiment of FIG. 1, is eliminated, thereby reducing the total cost of the system. However, storing wavetable data 222 in system memory rather than a dedicated memory introduces bandwidth problems with the I/O bus 206. The I/O bus 206 is a shared resource which is used by other components in the system, such as CPU 201, and other peripheral devices connected to the I/O bus 206. These devices must arbitrate for the I/O bus 206. This arbitration introduces a latency associated with fetching wavetable data samples. The present invention solves this problem as will be discussed shortly.

In one embodiment the chipset 204 includes an I/O bus arbiter which performs arbitration for the I/O bus 206 between the system audio device 220 and other peripheral devices (not shown). The I/O bus arbiter accommodates normal priority I/O bus requests and high priority I/O bus requests. The high priority I/O bus request mechanism enables devices to obtain mastership of the I/O bus 206 sooner than would normally be possible. By obtaining mastership of the I/O bus 206 sooner, the requesting device may obtain or supply time-critical data.

In one embodiment wavetable data 222 is initially contained in a permanent storage medium, such as a system disk drive. The wavetable audio data is transferred to system memory 202 prior to audio device 220 performing wavetable synthesis.

I/O bus 206 provides a sufficient bandwidth for samples of wavetable data 222 to be fetched at a rate to synthesize audio sound for a characteristic polyphony of voices at a characteristic frame rate. In the preferred embodiment the polyphony is 32 and the frame rate is 44,100 samples per second. In the preferred embodiment the audio device requires two samples of wavetable data per voice per frame time. In the preferred embodiment the width of a sample is 16 bits. Hence, in the preferred embodiment I/O bus 206 must be capable of sustaining 2,822,400 samples or 5,644,800 bytes per second of wavetable data transfer from system memory 202 to audio device 220 without significant impact on the performance of the PC system as a whole. In one embodiment, chipset 204 is the Triton Chipset made by Intel Corporation which is capable of sustaining data transfer rates in excess of 80 MB/sec.

Figure 3:
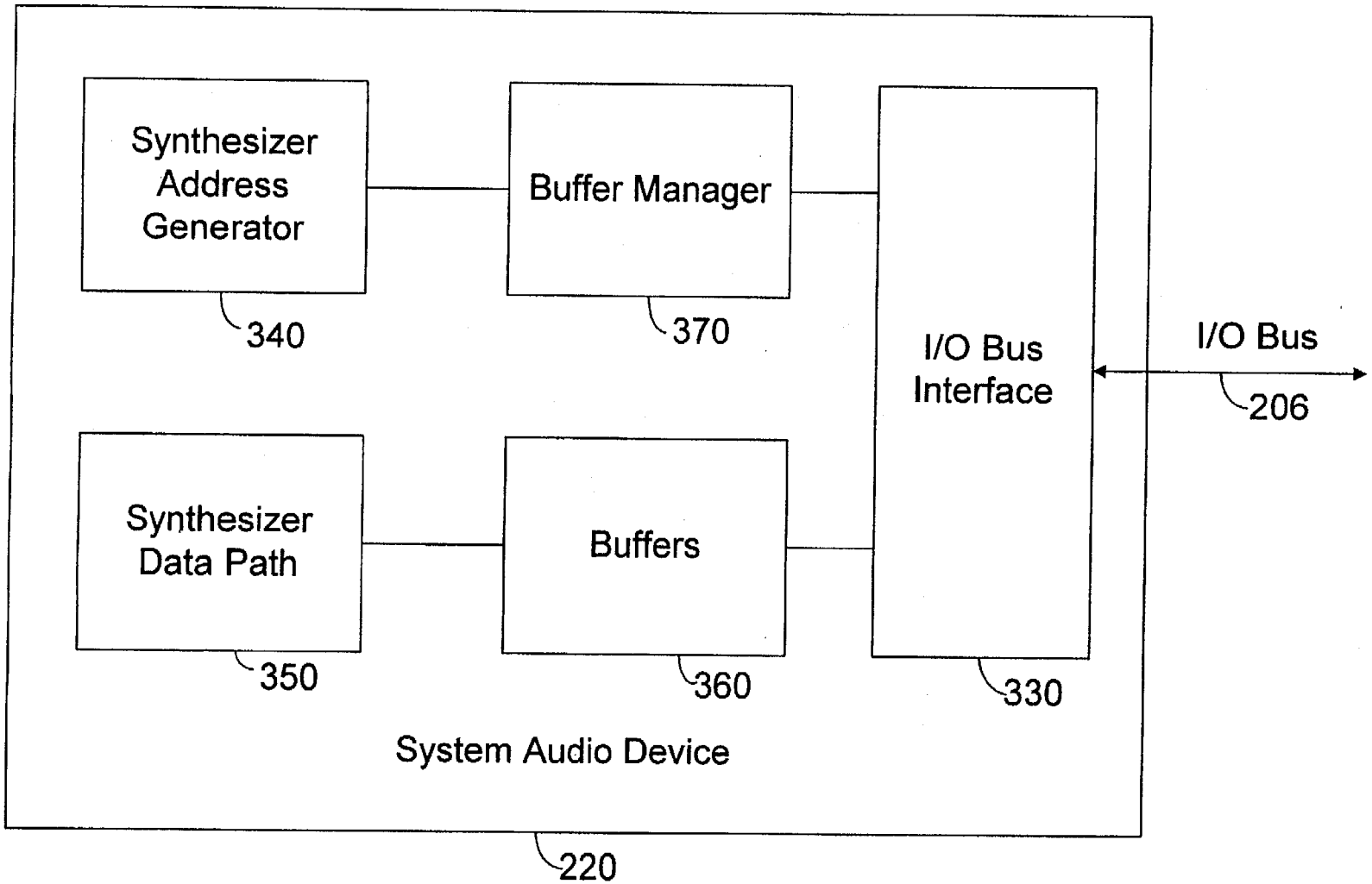
FIG. 3 is a block diagram illustrating more detailed portions of the system audio device shown in FIG. 2.

Turning now to FIG. 3, a block diagram of the preferred embodiment of audio device 220 of FIG. 2 is shown. Audio device 220 includes an I/O bus interface 330, a synthesizer address generator 340, a synthesizer data path 350, a plurality of buffers 360 and a buffer manager 370. The number of buffers 360 is equal to the number of voices which may be active simultaneously; i.e., each of buffers 360 corresponds to a voice. In the preferred embodiment this number is 32.

Synthesizer address generator 340 generates a request for two wavetable data samples each frame for each active voice. Synthesizer address generator 340 generates these requests one frame time before the samples are needed by synthesizer data path 350. Typically synthesizer address generator 340 generates requests for samples sequentially. In the preferred embodiment data samples for a given voice are stored sequentially in system memory 202. Hence, buffer manager 370 advantageously prefetches wavetable data samples for active voices into buffers 360 in anticipation of sequential requests from synthesizer address generator 340. In other words, buffer manager 370 fills buffers 360 in a predetermined fashion in order to avoid I/O bus latencies associated with fetching the samples. In the preferred embodiment the depth of each of buffers 360 is 10 and buffer manager 370 prefetches the number of samples of data required to fill the buffers for each active voice when the first active voice uses its eighth sample; i.e. when only 2 samples remain in the respective buffer. If synthesizer data path 350 does not receive the requested data sample by the time the synthesizer has used up the two sample pad (10–8=2) the synthesizer outputs a surrogate value to a digital-to-analog converter (not shown) until the new data sample becomes available. Hence, buffers 360 minimize the impact of conditions where I/O bus latencies are large.

The surrogate value is advantageously calculated so as to avoid introducing zipper noise. In the preferred embodiment, the surrogate value, and subsequent values, are the last value calculated by the synthesizer. Since the slope between two consecutive samples of equal value is zero, the slope does not exceed the maximum slope beyond which zipper noise is introduced.

In an alternate embodiment, the synthesizer calculates the surrogate value, and subsequent surrogate values, by ramping toward zero at the fastest rate which does not produce audible artifacts, i.e., zipper noise. If data samples are not available for a prolonged period of time, the surrogate value eventually becomes zero.

The synthesizer data path 350 comprises DSP hardware that performs operations typical of normal wavetable synthesizers including pitch interpolation, volume envelope generation, panning, etc.

I/O bus interface 330 arbitrates for, gains mastership of, and fetches wavetable data samples across I/O bus 206 into buffers 360 in response to requests from buffer manager 370.

In the preferred embodiment buffer manager 370 attempts to fill buffers 360 for all active voices in a given I/O bus 206 mastership, and thus minimizes the number of I/O bus 206 mastership requests per second and improves overall system performance. Accordingly, as can readily be observed, the greater the number of samples which can be prefetched into buffers 360 the fewer the number of I/O bus 206 mastership requests per second which audio device 220 must make. However, it should be noted that increasing the depth of buffers 360 increases the die size of the integrated circuit embodying audio device 220 and thus increases its cost.

Figure 4:
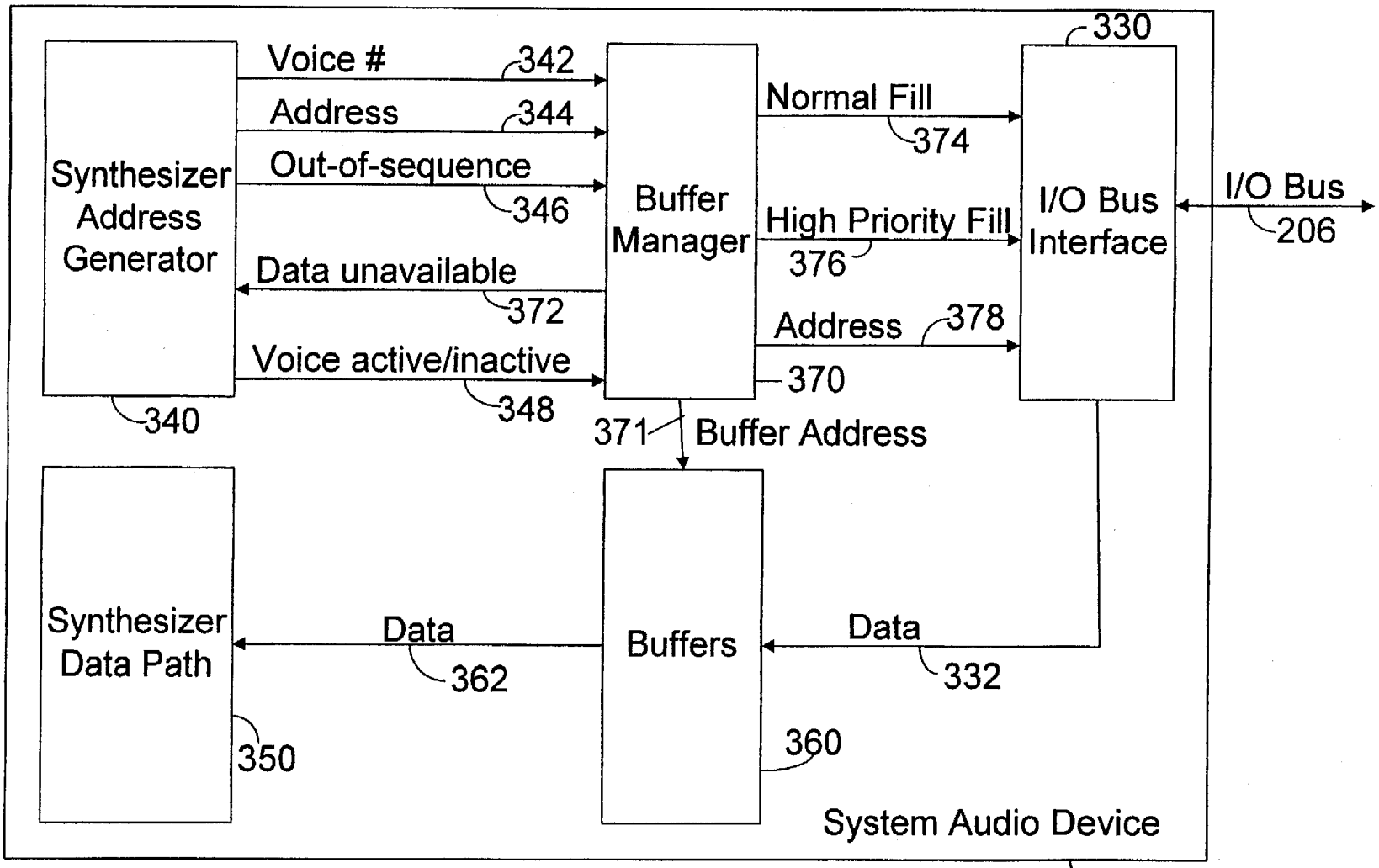
FIG. 4 is a block diagram illustrating more detailed portions of the system audio device shown in FIG. 3.

Turning now to FIG. 4, a block diagram of the preferred embodiment of audio device 220 of FIG. 3 is shown. Synthesizer address generator 340 generates requests for wavetable data samples to buffer manager 370 via voice number signals 342 and address signals 344. Address signals 344 specify the address in system memory of the desired wavetable data samples. Voice number signals 342 specify the voice number associated with the wavetable data samples. Synthesizer address generator 340 asserts out-of-sequence signal 346 to indicated that a given request is for a wavetable data sample which does not have a sequential address with the previous request. Synthesizer address generator 340 asserts voice active/inactive signal 348 which allows buffer manager 370 to determine that a new voice, the voice specified by voice number signals 342, has become active. Synthesizer address generator 340 generates a request for a pair of wavetable data samples to buffer manager 370 once per frame for each active voice.

When buffer manager 370 receives a request for wavetable data samples from synthesizer address generator 340 it determines whether the requested samples reside in buffers 360. If so, buffer manager 370 passes the requested samples from buffers 360 to synthesizer data path 350 on data bus 362 specified by buffer address 371. Buffer address 371 consists of two components, a voice number component and a buffer position component. The voice number component indicates which buffer within buffers 360 contains the requested samples. The buffer position component specifies which entry within the specified buffer contains the samples. In the preferred embodiment 5 bits are used to specify the voice number, thus providing the ability to specify 32 different voice numbers. In the preferred embodiment 4 bits are used to specify the buffer position, thus providing the ability to specify 10 locations within a buffer with a depth of 10.

If buffer manager 370 determines that the samples requested by synthesizer address generator 340 do not reside in buffers 360, buffer manager 370 asserts high priority fill request signal 376, i.e., generates a high priority fill request. In response to this assertion, I/O bus interface 330 generates a high priority I/O bus request and obtains mastership of I/O bus 206. Once I/O bus interface 330 obtains mastership of I/O bus 206 buffer manager 370 fills the buffer in buffers 360 corresponding to the voice number associated with the high priority request with wavetable data samples from system memory. These samples are specified by address signals 378 which are passed to I/O bus 206 by I/O bus interface 330. The samples are transferred from system memory on I/O bus 206, through I/O bus interface 330, onto data bus 332 and into buffers 360.

In the event that I/O bus interface 330 is unable to obtain mastership of I/O bus 206 within a desired frame time latency, buffer manager 370 asserts data unavailable signal 372 to notify synthesizer address generator 340 that the requested data sample was unavailable. If synthesizer data path 350 does not receive the requested data sample within the desired frame time the synthesizer outputs a surrogate value, as previously described, until the new data sample becomes available.

As mentioned in the description of FIG. 3, buffer manager 370 prefetches wavetable data samples in a sequential fashion. When buffer manager 370 determines such a fill, denoted as a normal fill request, of buffers 360 is required buffer manager 370 asserts normal fill request signal 374. In response to this assertion, I/O bus interface 330 arbitrates for and obtains mastership of I/O bus 206. Once I/O bus interface 330 obtains mastership of I/O bus 206 buffer manager 370 fills all of buffers 360 which correspond to active voices. In the event that a high priority fill request and a normal fill request are simultaneously pending when I/O bus interface 206 obtains bus mastership buffer manager 370 performs a fill associated with the high priority fill request before performing a fill associated with the normal fill request.

In the preferred embodiment I/O bus 206 is the PCI bus. As of revision 2.1 of the PCI specification, no provision exists for a high priority bus mastership request. However, it is noted that such a capability could be added to the specification in the future. It is further noted that the present invention is susceptible to implementations with other I/O buses, including future buses, which may in fact implement a high priority bus mastership request capability. In such a case, the invention described herein would advantageously employ such a capability.

Figure 5:
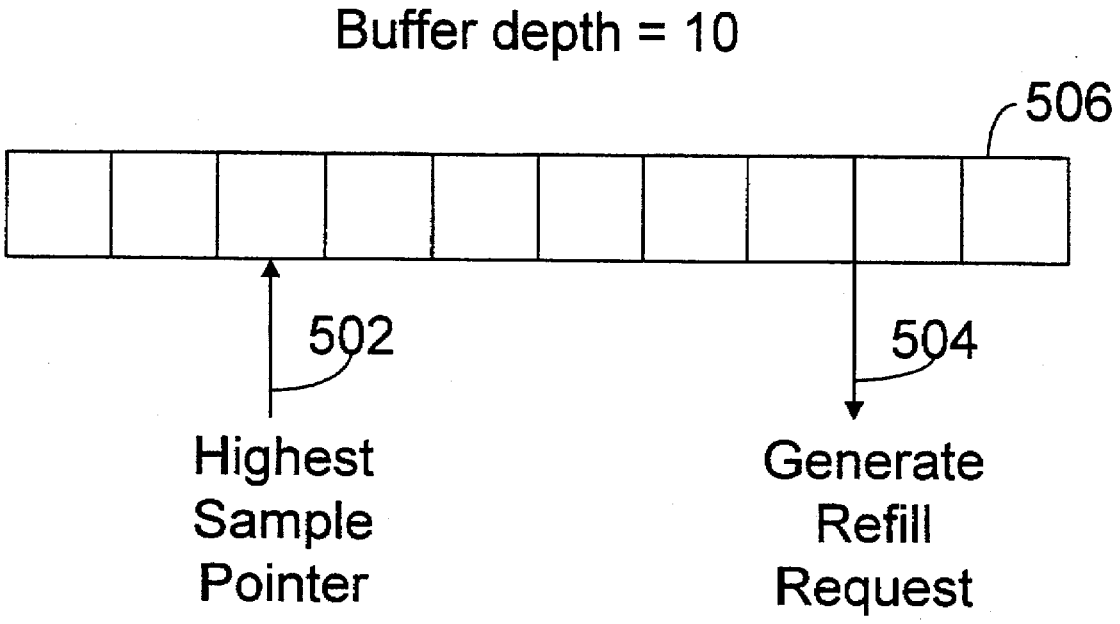
FIG. 5 is an illustration of a means of maintaining buffer location pointers for determining when to generate a buffer fill request.

Turning now to FIG. 5, an illustration of a buffer 506 is shown. Buffer 506 is exemplary of plurality of buffers 360 in FIGS. 3 and 4. In the embodiment shown, buffer 506 has a depth of 10, i.e., has 10 sample locations. Buffer manager 370 maintains a highest sample pointer 502 which points to the next available sample in buffer 506. Each time buffer 506 passes a new (higher numbered) sample to synthesizer data path 350, buffer manager 370 updates highest sample pointer 502 to point to the next available sample. When highest sample pointer 502 points to a predetermined generate fill request location 504, buffer manager 370 asserts normal fill request signal 374. In the preferred embodiment, generate fill request location 504 is where 2 samples remain in buffer 506. It is noted that various depths of buffer 506 and generate fill request location 504 may be realized and in describing the embodiment shown it is not the intention to preclude any such other variations.

Figure 6:
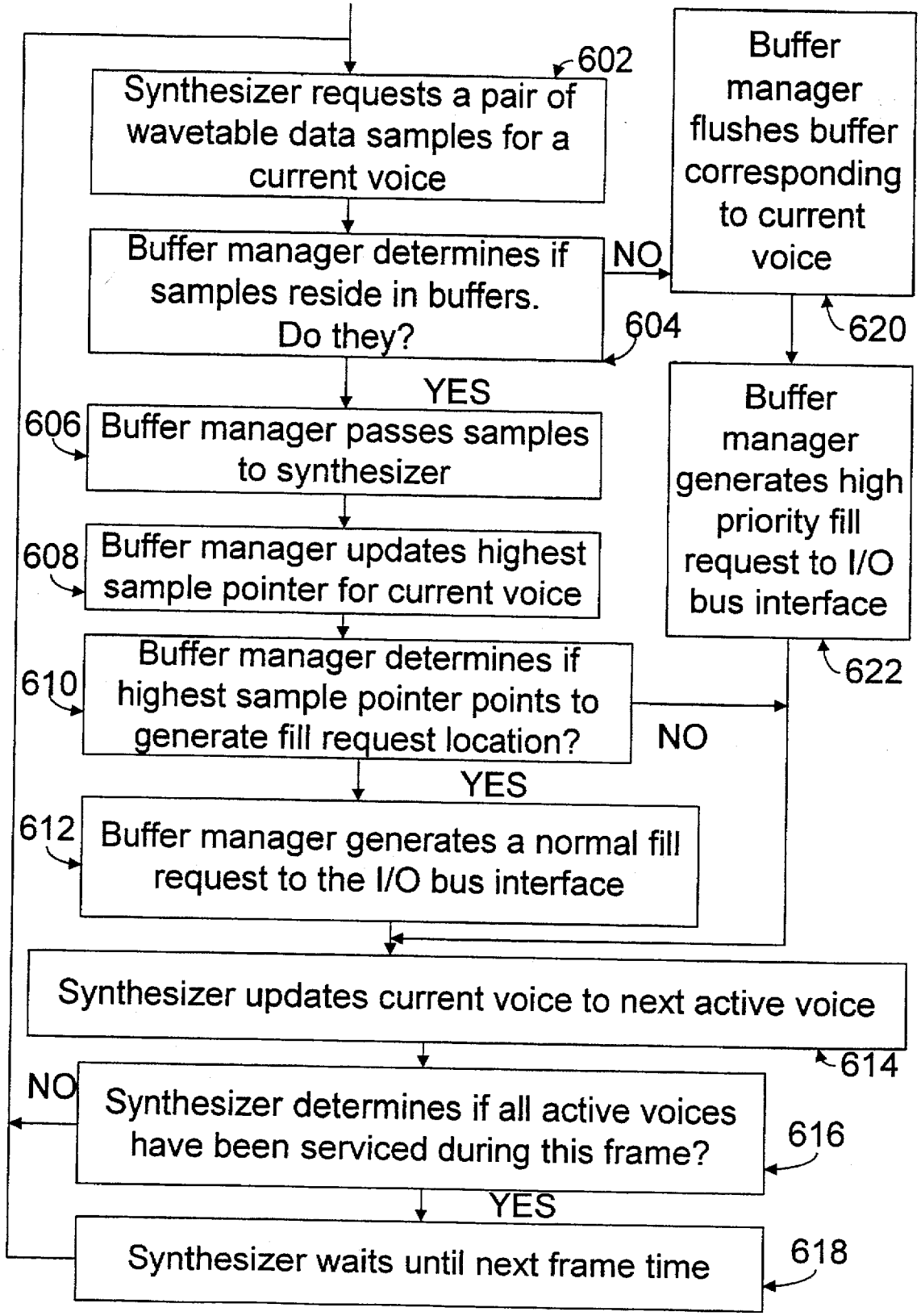
FIGS. 6, 7 and 8 are flowcharts illustrating some of the steps which the system audio device takes in performing wavetable music synthesis.

Turning now to FIG. 6, a flowchart illustrating steps which the present audio device invention takes in performing wavetable synthesis is shown. During normal operation, the synthesizer of the audio device requests a pair of wavetable data samples from the buffer manager of the audio device for a current voice in step 602. The synthesizer later takes these samples, performs interpolation on them, and generates musical notes or sounds with the calculated values. After the synthesizer requests samples in step 602, the buffer manager determines whether or not the requested samples reside in the plurality of buffers of the audio device in step 604. If the buffer manager determines that the samples do reside in the buffers then the buffer manager passes the samples on to the synthesizer in step 606. Otherwise, if the buffer manager determines that the samples do not reside in the buffers the buffer manager flushes the buffer associated with the current voice in step 620 and afterwards generates a high priority fill request to the I/O bus interface of the audio device in step 622.

After the buffer manager passes the samples on to the synthesizer in step 606, the buffer manager conditionally updates the highest sample pointer for the buffer associated with the current voice in step 608 to reflect the fact that the samples were passed to the synthesizer in step 606. After the buffer manager updates the highest sample pointer in step 608 the buffer manager determines if the updated highest sample pointer points to the generate fill request location in the buffer associated with the current voice in step 610. If the buffer manager determines in step 610 that the highest sample pointer in fact points to the generate fill request location the buffer manager generates a normal fill request to the I/O bus interface in step 612.

Meanwhile, the synthesizer, after requesting a pair of wavetable data samples in step 602 updates the current voice to the next active voice in step 614. By way of example, if voice number 17 was the current voice and voice 18 was inactive and voice 19 was active then in step 614 the synthesizer would update the current voice from 17 to 19. The buffer manager updates the current voice modulo the polyphony of the synthesizer. In other words if the voices were numbered 1 through 32, for example, and the current voice number was 32, and voice 1 was active, then in step 614 the synthesizer would update the current voice from 32 to 1. After the synthesizer updates the current voice in step 614 the synthesizer determines if all active voices have been serviced within the current frame time in step 616. In other words, the synthesizer fetches samples for each active voice only once per frame time. Therefore, if the synthesizer determines that it has not fetched samples for all the active voices in this frame in step 616 it will return to step 602 and repeat the process until it has fetched samples for all the active voices in this frame. Once the synthesizer determines in step 616 that samples have been fetched for all active voices in this frame the synthesizer waits until the start of the next frame time in step 618 and then returns to step 602 to start the process over again for all of the active voices in the next frame.

Figure 7:
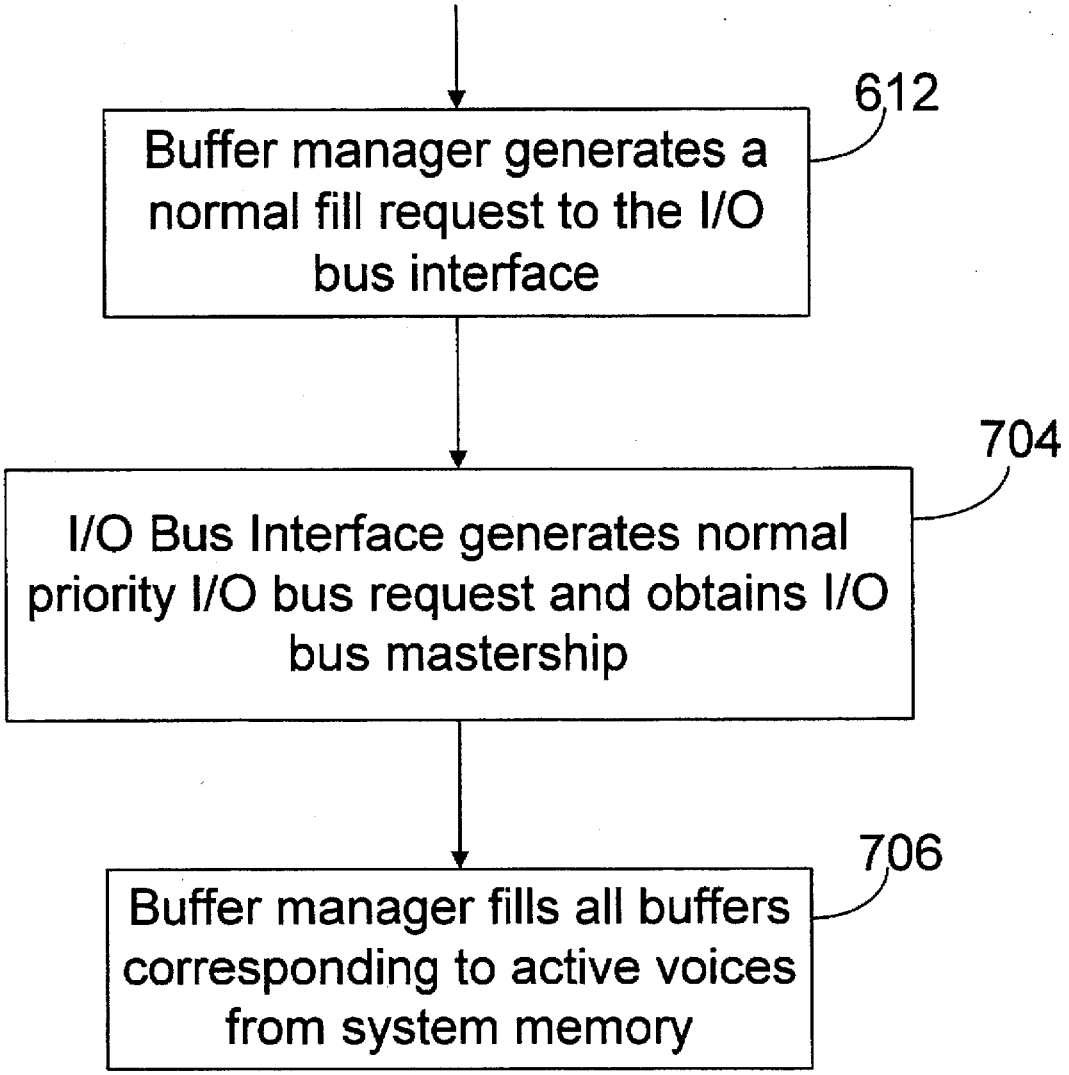

Turning now to FIG. 7, a flowchart illustrating steps which the present audio device invention takes in performing wavetable synthesis is shown. As was previously discussed regarding FIG. 6, in step 612 the buffer manager generates a normal fill request to the I/O bus interface as the result of having determined in step 610 that a fill of the active voices was needed. After the buffer manager generates a normal fill request to the I/O bus interface in step 612 the I/O bus interface arbitrates for the I/O bus and obtains bus mastership of the I/O bus in step 704. After the I/O bus interface obtains mastership of the I/O bus the buffer manager fills the active buffers with the appropriate wavetable data samples from the system memory in step 706. As previously discussed, this prefetching, in anticipation of sequential requests from the synthesizer address generator, advantageously avoids I/O bus latencies associated with fetching the samples from system memory.

Figure 8:
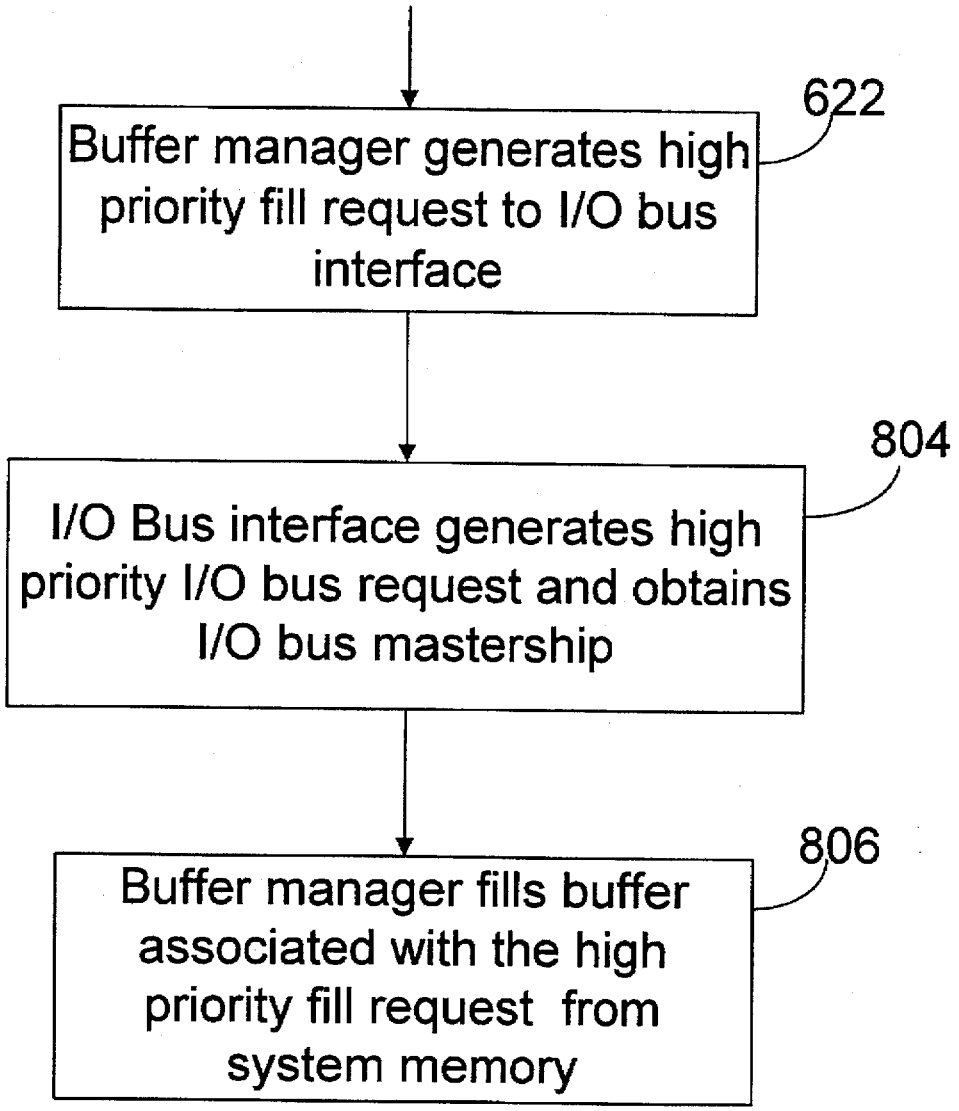

Turning now to FIG. 8, a flowchart illustrating steps which the present audio device invention takes in performing wavetable synthesis is shown. As was previously discussed regarding FIG. 6, in step 622 the buffer manager generates a high priority fill request to the I/O bus interface as the result of having determined in step 604 that the samples requested by the synthesizer in step 602 did not reside in the buffers. After the buffer manager generates a high priority fill request to the I/O bus interface in step 622 the I/O bus interface generates a high priority I/O bus request the I/O bus and obtains bus mastership of the I/O bus in step 804. After the I/O bus interface obtains mastership of the I/O bus the buffer manager fills the buffer associated with the high priority fill request with the appropriate wavetable data samples from the system memory in step 806. As previously discussed, if the I/O bus interface is unable to obtain ownership of the I/O bus and the samples requested by the synthesizer cannot be transferred from system memory to the synthesizer within a frame time due long I/O bus latencies then the synthesizer must output a surrogate value. This results in loss of audio fidelity. Hence, the preferred embodiment of the present invention fills buffers associated with high priority fill requests before normal fill requests. An additional consideration is that a normal fill request may not be able to be completed in a single bus mastership. Therefore, the preferred embodiment of the present invention performs high priority fill requests before normal priority fill requests.

Figure 9:
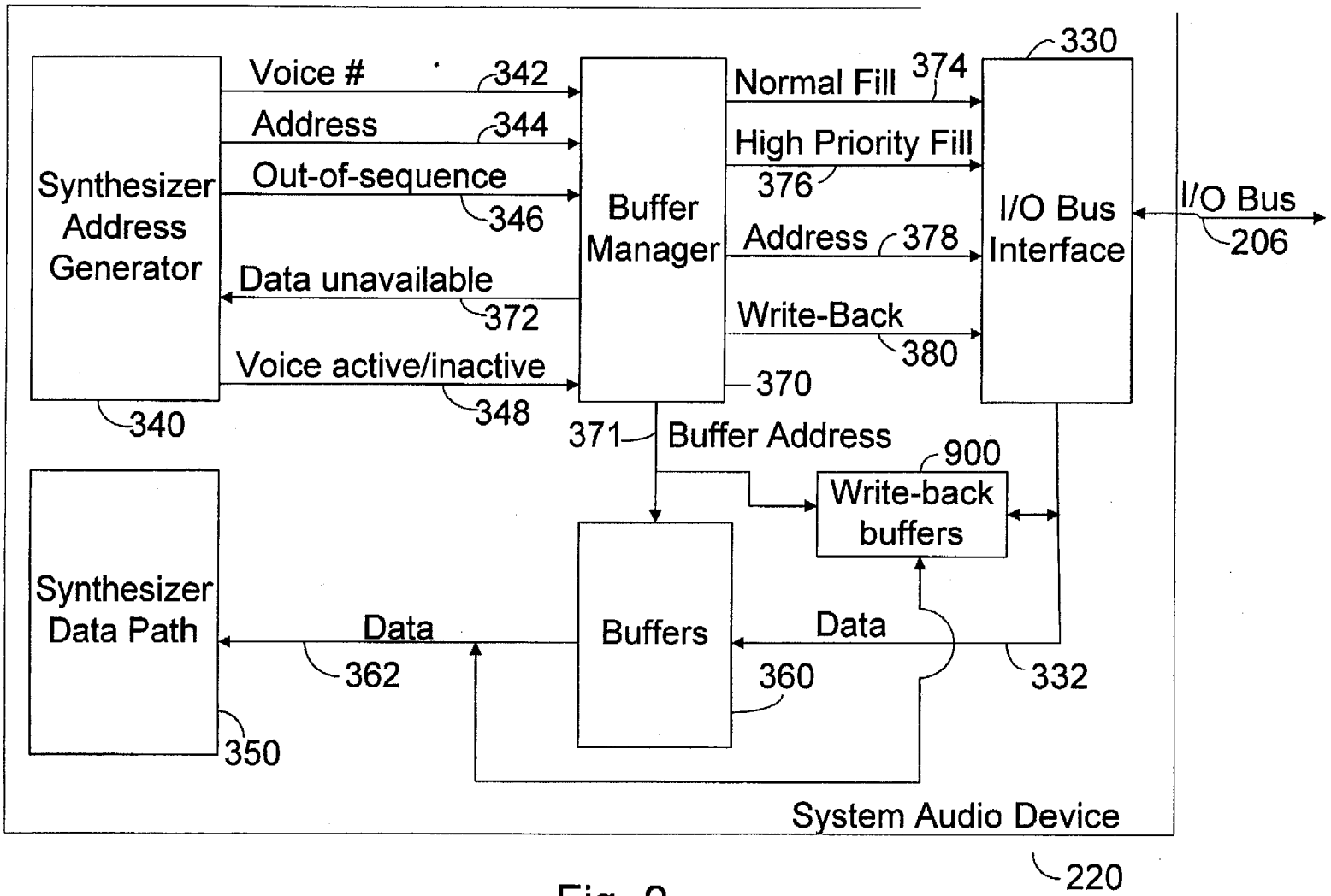
FIG. 9 is similar to that of FIG. 4 and in addition illustrating a set of write-back buffers for effects processing.

Turning now to FIG. 9, a block diagram of a second embodiment of audio device 220 of FIG. 3 is shown. The embodiment of FIG. 9 is similar to that of FIG. 4, and corresponding circuit portions are numbered identically for simplicity and clarity. The embodiment of FIG. 9 contemplates, in addition to the embodiment of FIG. 4, a plurality of write-back buffers 900. Buffers 900 are coupled to I/O bus interface 330, synthesizer data path 350 and buffer manager 370. System audio device 220 dedicates one of more buffers 360 to generating delay-based effects, such as reverb or echo. System audio device 220 advantageously employs buffers 900 in that, once per frame per dedicated effects voice, synthesizer address generator 340 reads a wavetable data sample from one location in system memory through buffers 360 and writes the sample back to a different location in system memory through one of write-back buffers 900. Buffer manager 370 performs the writes from buffers 900 back to system memory in a fashion so as to minimize the number of bus mastership requests which I/O bus interface 330 must make and to maximize the allowed I/O bus mastership latency of the I/O bus in a manner similar to that which the buffer manager employs for buffers 360, as mentioned in the discussion of FIG. 4, regarding maintaining sample pointers. In this case, buffer manager 370 writes back the data in buffers 900 when buffers 900 become a predetermined amount full. In the preferred embodiment the number of write-back buffers is 8 and each write-back buffer has a depth of 10 samples and buffer manager 370 performs writes back to system memory when a first voice becomes 8 samples full.

The write-back buffers 900 are similar to the buffers 360 shown in FIG. 5. The buffer manager 370 maintains a highest sample pointer for each write-back buffers 900 which points to the next empty entry in the write-back buffer. Each time the synthesizer data path 350 writes a sample into the write-back buffer, the buffer manager 370 updates the highest sample pointer to point to the next empty entry. When highest sample pointer points to a predetermined generate write-back request location, the buffer manager 370 asserts a write-back request signal 380, i.e., generates a write-back request. In the preferred embodiment, the generate write-back request location is where 2 empty entries remain in the write-back buffer. It is noted that various depths of the write-back buffers and generate write-back request location may be realized and in describing the embodiment shown it is not the intention to preclude any such other variations.

Figure 10:
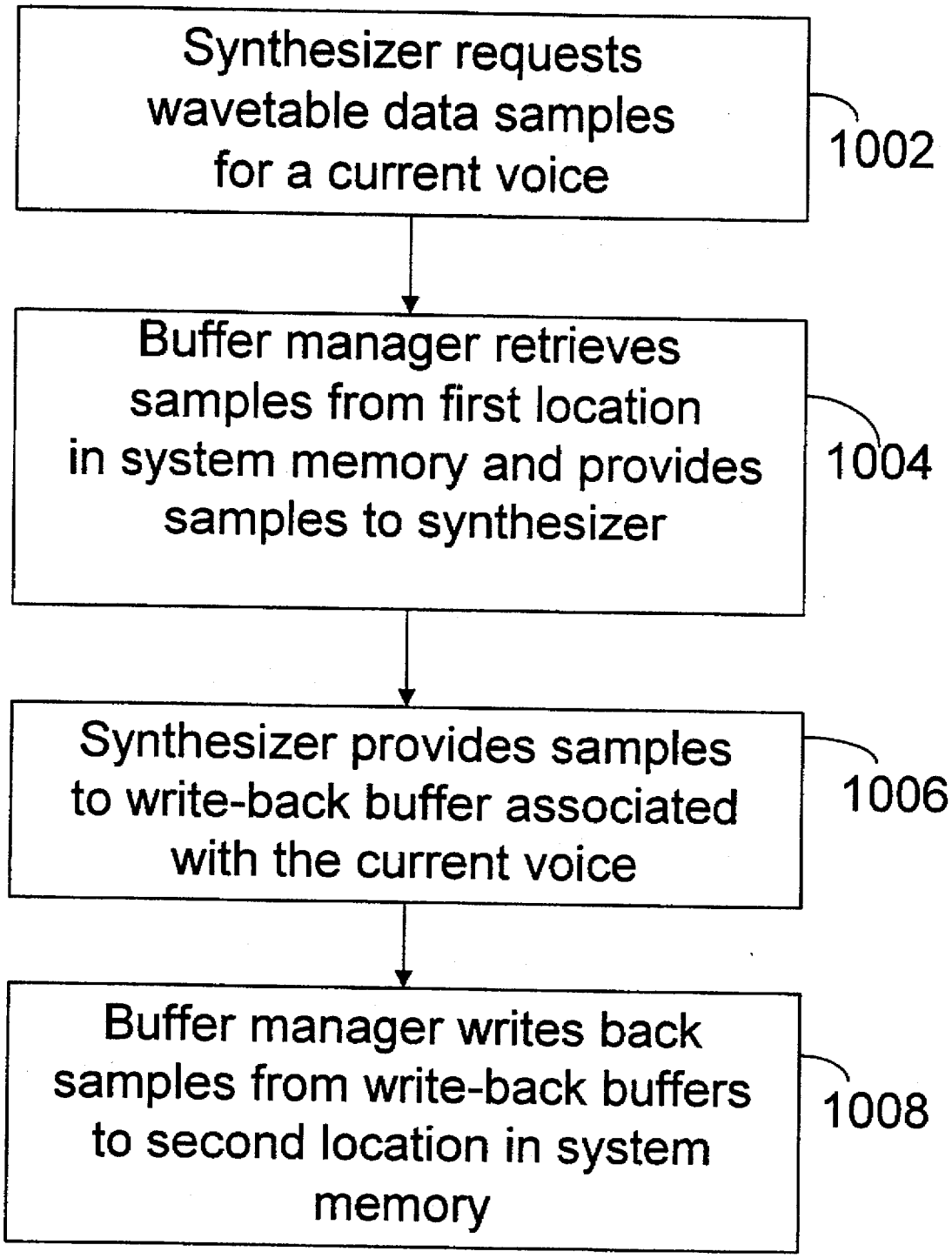
FIG. 10 is a flowchart illustrating some of the steps which the system audio device takes in generating delay based audio effects.

Turning now to FIG. 10, a flowchart illustrating steps which the present audio device invention takes in generating delay-based effects in a wavetable synthesis system is shown. During normal operation, the synthesizer of the audio device requests wavetable data samples from the buffer manager of the audio device for a current voice in step 1002. After the synthesizer requests samples in step 1002, the buffer manager retrieves the wavetable data samples from a first location in system memory and provides the samples to the synthesizer in step 1004. After the buffer manager retrieves the samples and provides them to the synthesizer in step 1004, the synthesizer provides the samples to one of the plurality of write-back buffers associated with the current voice in step 1006. After the synthesizer provides the samples to the write-back buffers in step 1006, the buffer manager writes back the samples to a second location in system memory in step 1008.

Numerous variations and modifications will become apparent to those skilled in the art once the above disclosure is fully appreciated. It is intended that the following claims be interpreted to embrace all such variations and modifications.

What is claimed is:

1. A computer system for performing wavetable music synthesis comprising:

a system memory, said system memory storing wavetable data;

an I/O bus coupled to said system memory; and a system audio device comprising:

an I/O bus interface coupled to said I/O bus; and a synthesizer coupled to said I/O bus interface, wherein said synthesizer generates a request to said I/O bus interface for one or more wavetable data samples, wherein said synthesizer generates sounds in response to said one or more wavetable data samples;

wherein if said system audio device is unable to retrieve said one or more wavetable data samples within a desired frame time said synthesizer outputs one or more surrogate values, wherein said synthesizer calculates said surrogate values so as to avoid producing audible artifacts in said sound generated by said synthesizer.

2. The system of claim 1, wherein said surrogate values are the previous value calculated by the synthesizer.

3. The system of claim 1, wherein said synthesizer calculates said surrogate values to ramp toward zero at a rate which does not produce audible artifacts in said sound generated by said synthesizer.

4. The system of claim 1 wherein said I/O bus is the PCI bus.

5. A method of performing wavetable music synthesis in a system comprising a system memory storing wavetable data samples, an I/O bus, and a system audio device, said system audio device having an I/O bus interface coupled to said I/O bus, and a synthesizer coupled to said I/O bus interface, comprising:

said synthesizer generating a request to said I/O bus interface for one or more wavetable data samples;

determining if said one or more wavetable data samples are unavailable to said synthesizer within a desired frame time;

said synthesizer calculating a surrogate value if said one or more wavetable data samples are unavailable to said synthesizer within a desired frame time, wherein said surrogate value avoids producing audible artifacts in sound generated by said synthesizer;

said synthesizer outputting said surrogate value.

6. The method of claim 5, wherein said synthesizer calculating a surrogate value comprises said synthesizer calculating said surrogate value to be the value calculated by the synthesizer for the previous frame.

7. The method of claim 5, wherein said synthesizer calculating a surrogate value comprises said synthesizer calculating said surrogate value to be the value which ramps toward zero at a rate which does not produce audible artifacts.

8. A computer system for performing wavetable music synthesis comprising:

a system memory, said system memory storing wavetable data;

an I/O bus coupled to said system memory; and a system audio device comprising:

an I/O bus interface coupled to said I/O bus;

a synthesizer which generates sounds in response to said wavetable data;

a plurality of buffers coupled to said I/O bus interface and to said synthesizer for buffering said wavetable data from said system memory; and a buffer manager coupled to said I/O bus interface, said synthesizer, and said plurality of buffers, for managing transfers of said wavetable data from said system memory to said buffers;

wherein said wavetable data is transferred from said buffers to said synthesizer;

wherein said synthesizer generates a request to said buffer manager for one or more wavetable data samples;

wherein said one or more samples do not reside in said plurality of buffers and said buffer manager is unable to retrieve said one or more wavetable data samples within a desired frame time, wherein said synthesizer outputs one or more surrogate values, wherein said synthesizer calculates said surrogate values so as to avoid producing audible artifacts in said sound generated by said synthesizer.

9. The system of claim 8, wherein said surrogate values are the previous value calculated by the synthesizer.

10. The system of claim 8, wherein said synthesizer calculates said surrogate values to ramp toward zero at a rate which does not produce audible artifacts in said sound generated by said synthesizer.

11. The system of claim 8, wherein said buffer manager generates a data unavailable signal, indicating that one or more of said one or more samples do not reside in said plurality of buffers and said buffer manager is unable to retrieve said one or more wavetable data samples within a desired frame time;

wherein said buffer manager asserts said data unavailable signal, wherein said synthesizer outputs said one or more said surrogate values in response to said data unavailable signal until said one or more wavetable data samples becomes available.

12. The system of claim 8, wherein said I/O bus is the PCI bus.

13. A method of performing wavetable music synthesis in a system comprising a system memory storing wavetable data samples, an I/O bus, and a system audio device, said system audio device having an I/O bus interface coupled to said I/O bus, a synthesizer, a plurality of buffers coupled to said I/O bus interface and said synthesizer, and a buffer manager coupled to said I/O bus interface, said synthesizer, and said plurality of buffers, comprising:

said synthesizer generating a request to said buffer manager for one or more wavetable data samples;

said buffer manager determining if said one or more samples reside in said plurality of buffers;

said buffer manager attempting to retrieve said one or more samples from said system memory if said buffer manager determines said one or more samples do not reside in said plurality of buffers;

said synthesizer calculating a surrogate value if said buffer manager is unable to retrieve said one or more wavetable data samples from said system memory within a desired frame time, wherein said surrogate value avoids producing audible artifacts in sound generated by said synthesizer;

said synthesizer outputting said surrogate value.

14. The method of claim 13, wherein said synthesizer calculating a surrogate value comprises said synthesizer calculating said surrogate value to be the value calculated by the synthesizer for the previous frame.

15. The method of claim 13, wherein said synthesizer calculating a surrogate value comprises said synthesizer calculating said surrogate value to be the value which ramps toward zero at a rate which does not produce audible artifacts.

* * * * *